United States Patent [19]

Walker et al.

[11] 4,054,110

[45] Oct. 18, 1977

[54] ENGINE SPARK TIMING DEVICE

[75] Inventors: Brooks Walker; Fred V. Hall, both of San Francisco, Calif.

[73] Assignee: Brooks Walker, San Francisco, Calif.

[21] Appl. No.: 260,484

[22] Filed: June 7, 1972

Related U.S. Application Data

[63] Continuation-in-part of Ser. No. 615,469, Feb. 13, 1967, abandoned, and a continuation-in-part of Ser. No. 90,457, Nov. 17, 1970, abandoned.

[51] Int. Cl.[2] ..... F02P 5/04

[52] U.S. Cl. ..... 123/117 A

[58] Field of Search ..... 123/117 R, 117 A, 97 B

[56] References Cited

U.S. PATENT DOCUMENTS

| | | | |
|---|---|---|---|
| 1,969,682 | 8/1934 | Arthur | 123/117 |
| 2,273,352 | 2/1942 | Hans | 123/117 A |
| 3,162,184 | 12/1964 | Walker | 123/117 A |
| 3,426,737 | 2/1969 | Walker | 123/117 A |
| 3,447,518 | 6/1969 | Walker | 123/117 A |
| 3,456,633 | 7/1969 | Walker | 123/117 A |
| 3,457,905 | 7/1969 | Jukes | 123/117 A |
| 3,476,094 | 11/1969 | Rucins | 123/117 |
| 3,515,105 | 6/1970 | Soeters | 123/117 |

*Primary Examiner*—Ronald B. Cox

*Attorney, Agent, or Firm*—Everett G. Clements; Jay M. Cantor

[57] ABSTRACT

A device for retarding the timing of the spark during the initial phase of acceleration of an internal combustion engine. A bar is connected to the throttle operating linkage and to a valve. Motion of the bar operates the valve to connect carburetor suction to a spark retarding motor. A timing mechanism operates the valve to remove the suction from the retard motor after the initial phase of acceleration.

11 Claims, 3 Drawing Figures

ENGINE SPARK TIMING DEVICE

DISCLOSURE OF THE INVENTION

This application is a continuation-in-part of our co-pending application, Ser. No. 615,469, filed Feb. 13, 1967, for Engine Spark Timing Device, now abandoned, and a continuation-in-part of application Ser. No. 90,457, filed Nov. 17, 1970 now abandoned.

This invention relates to a device to control the spark timing of a spark ignition internal combustion engine. More particularly, it provides a control which retards the spark timing in a predetermined manner during the initial portion of an acceleration to improve combustion and thereby reduce smog forming pollutants in the exhaust.

Any means for raising the general temperature of the exhaust gas will improve combustion and spark retard from normal advance is very effective in doing this. Engines operated with retarded spark timing run hotter than those with normal timing and assuming adequate oxygen (from air) is available for combustion more complete combustion is accomplished. With retarded spark timing there is more heat rejection to the cooling jacket and the combustion chamber walls are hotter thereby reducing quenching effects conducive to producing unburned hydrocarbons and carbon monoxide. The exhaust gas also runs hotter which can be beneficial in regard to obtaining more complete combustion.

Retarded spark while improving combustion, however, has an adverse effect on specific fuel consumption (lbs. of fuel per horsepower-hour) the net effect of which is loss in "miles per gallon" of gasoline. It can readily be appreciated, therefore, that major spark retard from normal advance cannot be used continuously without serious consequences in regard to problems of excessive fuel consumption, performance loss and possible engine overheating. Properly applied, nevertheless, temporary spark retard from normal spark advance is very effective in improving combustion without unduly affecting power of fuel economy. This invention provides such a control.

The present invention concerns itself primarily with retard of spark timing compared to normal spark advance during the initial phase of an acceleration after which time such spark timing is automatically returned to "normal". This is particularly important when you consider the relative contribution of the acceleration cycle as compared to the other modes of engine operation such as deceleration, cruise and idle. Many studies have been made to establish the relative contribution of each mode of engine operation for a "typical driver" operating his automobile under urban driving conditions. Tabulated below are the relative contributions of each mode of driving from a study made to develop a typical standard driving cycle to be used in testing cars and smog control devices by the Los Angeles Air Pollution Control District:

| Driving Mode | Percentage of Total Sample by Volume |
|---|---|
| Idle | 4.2 |
| Cruise | |
| 20 mph | 5.0 |
| 30 mph | 6.1 |
| 40 mph | 4.2 |
| 50 mph | 1.5 |
| Acceleration | |

-continued

| Driving Mode | Percentage of Total Sample by Volume | |
|---|---|---|
| 0–60 mph | 5.9 | 69.9 |
| 0–25 mph | 18.5 | |
| 15–30 mph | 45.5) | |
| Deceleration | | |
| 50–20 mph | 2.9 | |
| 30–15 mph | 3.3 | |
| 30–0 mph | 2.9 | |
| | 100.00 | |

Note particularly that acceleration in "typical" driving accounts for 69.9% of the total volume of exhaust emitted from an automobile. Thus is can be readily appreciated that any improvement in combustion during the acceleration phase of automobile engine operation is of great importance in reducing the total contribution.

It must be emphasized at this point that while spark retard is extremely effective in improving combustion, it cannot be used continuously during all modes of operation or for that matter continuously under engine operating conditions defined as acceleration. The main reason is that the same type power settings employed for acceleration are also used for "hill climbing". If continuous spark retard was employed it would seriously limit hill climbing performace at part throttle and more than likely result also in serious engine overheating. With the present invention this only applies to "part throttle" engine operation because the control is vacuum operated and is inherently inoperative at full throttle (essentially a "no vacuum" condition) operation. It therefore has no effect on full throttle power which is highly desirable so that maximum performance can be obtained when needed in dangerous "passing" situations or for severe hill climbing.

To solve the problem of excessive emission of smog producing pollutants during the acceleration phase of engine operation, the present invention provides novel control means to retard the spark timing during a portion (e.g., the initial 3–10 seconds) of the acceleration cycle and means to return the spark timing to "normal" after a predetermined time.

The use of a reservoir to establish a differential pressure relative to the intake manifold suction has been described in co-pending application entitled "Servo Mechanism", Ser. No. 571,563, dated Aug. 10, 1966, for the purpose of initiating retard after the start of an acceleration.

Other objects of the invention are:

1. To provide a temporary retard compared to normal spark advance for 3–10 seconds after the start of an acceleration at less than full throttle and then return the spark timing to normal using the motion of a portion of the linkage between the foot throttle and the throttle butterfly to sense the accelerations.
2. To accomplish the above purpose by the use of the spark advance and/or retard mechanism as controlled by intake manifold suctions.
3. To temporarily cut out the suction operated spark advance as distinguished from the governor actuated advance common to the drive for the spark breaker cam during the start of an acceleration at part throttle.
4. To use a clutch on the throttle operating linkage to sense the start of an acceleration to trigger a timing device to temporarily retard the spark relative to normal timing following the start of a part throttle acceleration.

5. To render such temporary relative retard as sensing by throttle linkage motion ineffective at full throttle accelerations when only a slight suction exist in the intake manifold.
6. To sense the start of a part throttle acceleration and start a relative retard of the spark compared to normal and maintain this relative retard for a predetermined time and then return the spark timing to normal automatically without special action by the operator.

Other objects and advantages of the invention will appear and will be explained more clearly and understood better from the following description of a preferred embodiment of the invention presented in accordance with the statutes.

IN THE DRAWINGS

Figure 1:
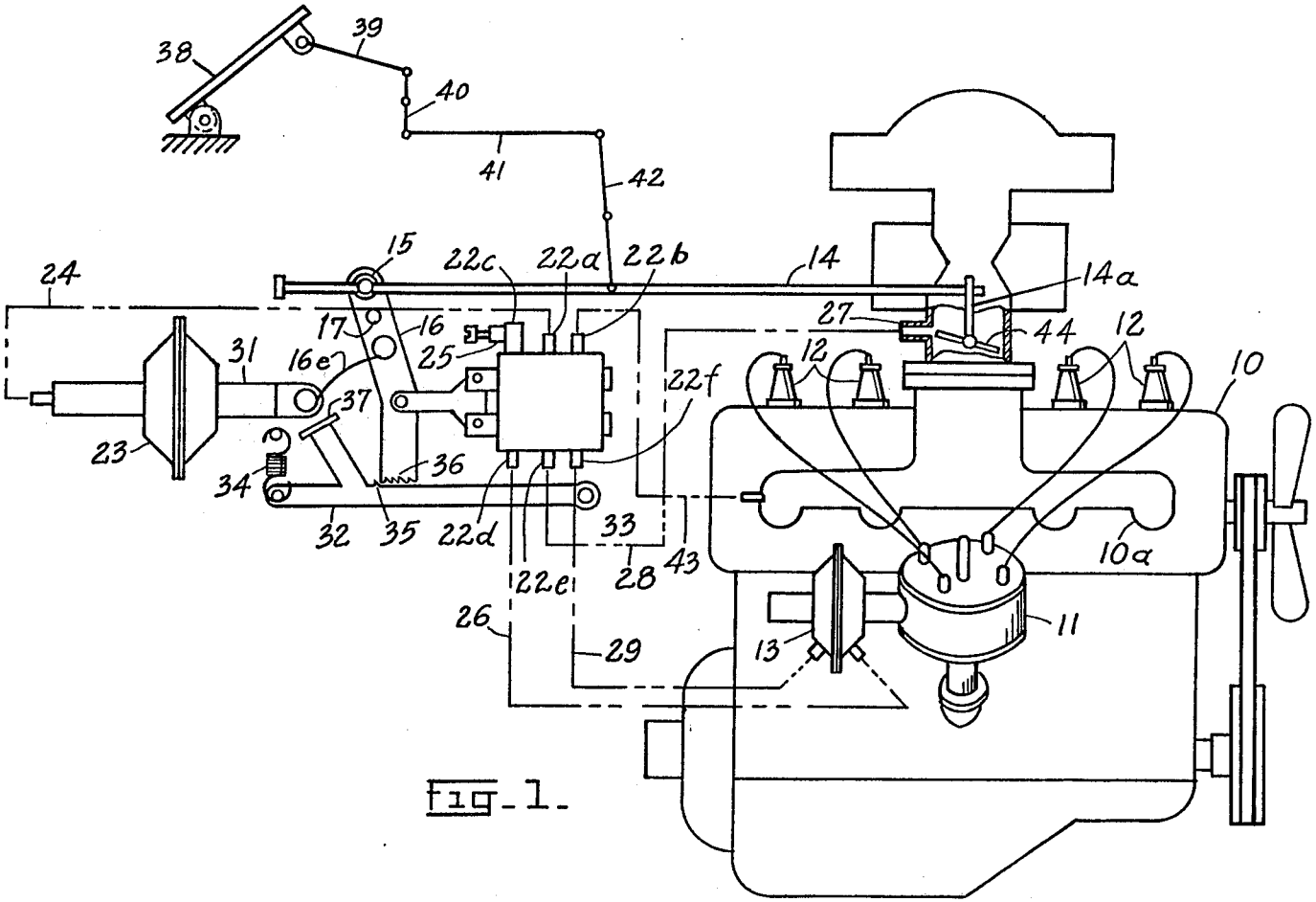
FIG. 1 is a schematic drawing of a system embodying the principles of the present invention for controlling the spark timing of a spark ignition engine.

FIG. 1 shows a gasoline engine 10 and pertinent portions of a system concerned with the present invention. Its ignition system consists of distributor 11, spark plugs 12 and a double acting diaphragm actuator 13 which regulates the spark timing of gasoline engine 10. These are sometimes conventional components for automotive engines. Other parts not pertinent to the present invention are not shown.

The present invention provides a rod 14 which leads to slipping clutch actuator 15 which pivots at the upper end of lever 16. Clutch actuator 15 carries a compression spring **15*a* which presses on friction ball 15*b*. The compression of spring 15*a* is controlled by friction adjusting acrew 15*c*. Lever 16 rotates on pivot 17 which is attached to plate 18. The travel of lever 16 is limited by stops 16*a* and 16*b*. Yoke 19 is attached near the lower end of lever 17 and engages spool valves 20*a* and 20*b*. Spool valves 20*a* and 20*b* slide in valve body 21**.

Valve port **22*a* connects to time diaphragm assembly 23 by means of a tube shown as a dot-dash line 24. Valve port 22*b* connects to manifold vacuum as indicated by dot-dash line 43 which leads to intake manifold 10*a* of engine 10. Valve port 22*c* leads to the atmosphere through bleed down timing valve 25 which can be adjusted to provide a preselected time interval for the removal of the suction. Valve port 22*d* is connected to the retard side of double acting diaphragm actuator 13 as shown by dot-dash line 26. Valve port 22*e* is connected to the throttle body vacuum port 27 as shown by dot-dash line 28. Valve port 22*f* is connected to the advance side of double acting diaphragm actuator 13 as shown by dot-dash line 29**.

Timer diaphragm assembly 23 consists of flexible diaphragm 30 to which is attached link 31. Flexible diaphragm 30 is urged to the right by compression spring **31*a***.

Pawl lever 32 rotates on pivot 33 which is attached to plate 18. Tension spring 34 urges pawl lever 32 upward causing pawl 35 to be forced against ratchet 36 at lower end of lever 16. Pawl lever 32 carries cam plate 37 which is in portion to be cammed downward by the right end of link 31.

The conventional throttle butterfly 44, FIG. 1 is actuated by rod 14 and lever **14*a*. Rod 14 is connected to accelerator pedal 38 by rod 39, lever 40, rod 41 and lever 42**.

Figures 2, 3:
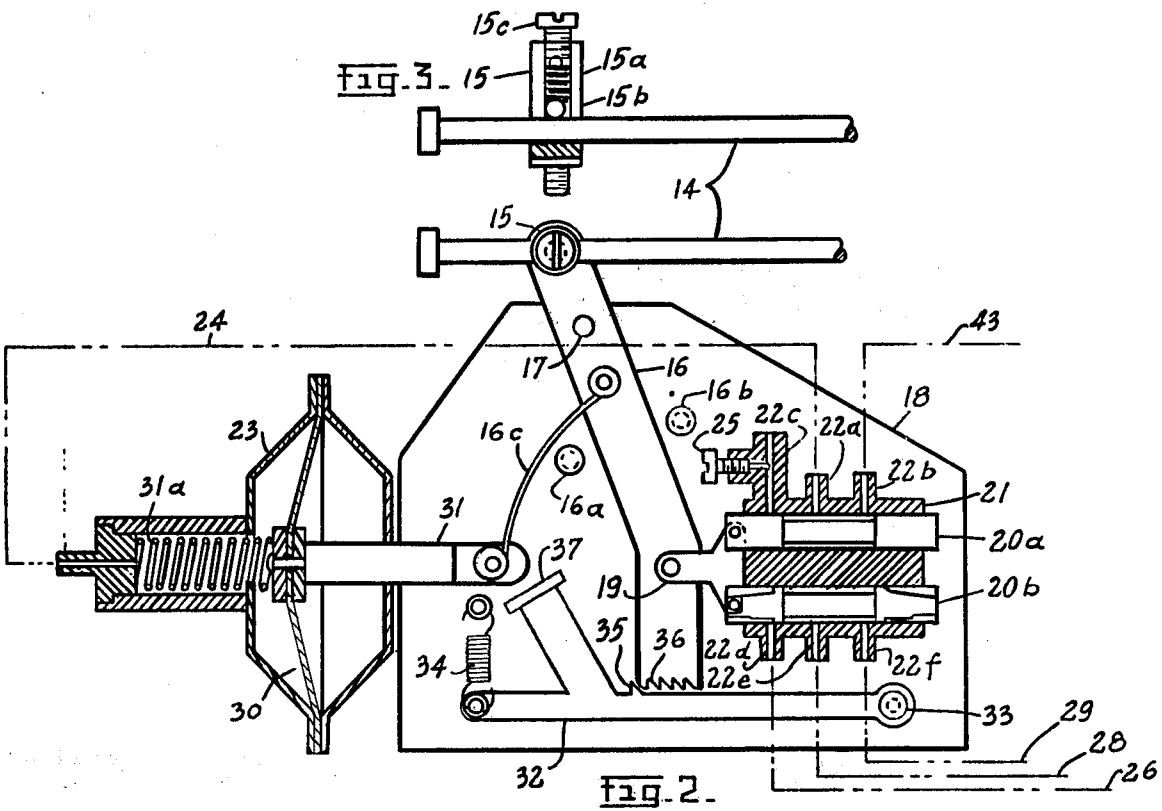
FIG. 2 is an enlarged view in elevation and in section of the primary elements of the control unit which provides the signal to vary the spark timing of a conventional automotive distributor.
FIG. 3 is an enlarged view in plan and partly in section of the slipping clutch actuator.

Lines 26 and 29 may be vented to atmosphere through the clearance between the valve **20*b* and valve body 21. This is the clearance which exists because of the looseness of fit necessary to allow the valve to slide in the valve body. The volume of fluid which is transmitted by the valve is large compared to the amount that can bleed through this clearance space. As a practical matter however, the enlarged members or lands 20*c* of the spool valve 20*b* have their inner portions dimensioned to provide a snug sliding fit with the valve body, while the outer portions thereof are of reduced diameter. The axial length of the inner portions of members 20*c* are such that when the valves are at their extreme right or left positions, as shown in FIG. 3, they will be located inwardly of ports 22*d* and 22*f* respectively, to expose them to atmosphere through passageways provided by the reduced dimensions of valve portions 20*c***.

OPERATION

With engine 10 operating normally in an automobile and cruising for example at 15 miles per hour, the driver presses accelerator pedal 38 to increase the speed of the vehicle. When accelerator pedal 38 is moved a very small amount, the throttle butterfly is opened more by means of rod 39, lever 40, rod 41, and lever 42, increasing engine power and thereby increasing engine speed when driving on the level. At the instant of throttle movement, lever 16 rotates slightly in a clockwise direction because of the friction of friction ball **15*a* on rod 14. When lever 16 rotates, it moves spool valves 20*a* and 20*b* to the left by means of yoke 19 which applies throttle body vacuum to the spark retard side of double acting actuator diaphragm 13 through a tube shown as dot-dash line 26. This causes the distributor 11 to retard the spark timing relative to normal spark advance as controlled by the governor advance and vacuum operated advance. At the same time spool valve port 22*c* is opened to the atmosphere through bleed down timer valve 25 which starts the bleed down cycle of timer diaphragm assembly 23 which was previously in the "cocked" position because of engine vacuum communicated to it through a tube shown as dot-dash line 43, spool valve 20*a* and a tube shown as dot-dash line 24**.

In addition, when lever 16 rotated to the limit stop **16*a* pawl 35 was depressed and engaged itself in ratchet 36 locking spool valves 20*b* and 20*a*** in their farthest left hand motion.

Now the bleed down of timer diaphragm assembly is in process and as previously indicated, the duration may be controlled by bleed down timer valve 25, which may be in the range of 5–10 seconds. Near the end of the bleed down cycle, the right hand end of link 31 contacts cam plate 37 and cams pawl lever 32 downward releasing pawl 35 from ratchet 36. Force transmitted to link 16 from link 31 by leaf spring **16*c* forces spool valves 20*a* and 20*b*** to the farthest right hand position.

Now that the spool valves **20*a* and 20*b* are in the farthest right hand position, timer diaphragm assembly 23** is returned to the "cocked" position previously referred to and the entire mechanism is cocked and ready for the next throttle opening (acceleration) movement.

While the main purpose of the present invention is to provide retarded spark compared to normal spark advance for a controllable time interval immediately following an acceleration as sensed by throttle linkage motion, it should be pointed out that basically the device responds to change in throttle position. It can, therefore, be used to initiate spark control of various types in response to change of throttle position. For example, it can be used to change the spark control (advance or retard) in response to deceleration by merely changing the direction (e.g., with a lever) of travel of the rod (14) in relation to acceleration travel.

To those skilled in the art to which this invention relates, many changes in construction and widely differing embodiments and applications of the invention will suggest themselves without departing from the spirit and scope of the invention. The disclosures and description herein are purely illustrative and are not intended to be in any sense limiting.

We claim:

1. A spark timing control for an internal combustion engine having a timed spark producing means, a throttle and a control mechanism connected thereto for accelerating the engine, the timing control comprising a suction motor cooperating with said timed spark producing means and means for supplying suction to operate said motor to advance and retard the timing of the spark; the means for retarding the spark comprising mechanical means connected to and responsive to any initial movement of the throttle control mechanism from any position thereof to initiate the supply of suction to said motor to retard production of the spark during such initial phase of movement of the said mechanism to accelerate the engine and to thereafter maintain such supply, and timing means simultaneously rendered operative in response to said initial phase of movement of the mechanism for removing the supply of suction to terminate retardation of the spark after a preselected time interval of more than one second following said initiation of the supply.

2. A spark timing control for an internal combination engine having a timed spark producing means, a throttle and a control mechanism connected thereto for accelerating the engine, the timing control comprising a suction motor and means for supplying suction to operate said motor to advance and retard the timing of the spark; the means for retarding the spark comprising mechanical means connected to and responsive to movement of the throttle control mechanism to initiate the supply of suction to the motor to retard production of the spark during the initial phase of movement of the said mechanism to accelerate the engine and to thereafter maintain such supply, and timing means rendered operative in response to said initial phase of movement of the mechanism for removing the supply of suction to terminate retardation of the spark after a preselected time interval following said initiation of the supply, wherein the means connected to and responsive to the movement of the throttle control mechanism to initiate the supply of suction to the motor comprises a lever, valve means connected to the lever for supplying suction to the motor from a source of suction to operate it to retard the timing of the spark, and means for locking the valve means in suction supplying position.

3. A device as defined in claim 2 wherein the timing means for removing the supply of suction to the motor to terminate its spark time retarding operation comprises means for releasing the valve means from locked position and for actuating it to suction cut-off position after said preselected time interval.

4. A spark timing control according to claim 2 wherein the timing means is provided with an adjusting means to vary the preselected time interval.

5. A spark timing control for an internal combustion engine having a throttle and a control mechanism connected thereto for accelerating the engine, said timing control comprising, a suction motor having first and second means responsive to engine developed suction to respectively operate the motor to advance and retard the spark, means normally operative to cut off suction to the second means for rendering the motor inoperative to retard the spark, mechanical means responsive to movement of the throttle control mechanism to accelerate the engine to initiate supply of suction to the second means for operating the motor to retard the spark and to cut off suction to the first means, to render the motor inoperative to advance the spark during the initial phase of movement of the mechanism, and to thereafter maintain such supply of suction, and timing means rendered operative in response to said initial phase of movement of the mechanism, for cutting off the supply of suction to the second means after a preselected time interval following said initiation of the supply of suction, and to connect the first means to the supply of suction.

6. A spark timing control for an internal combustion engine having a throttle and a control mechanism connected thereto for accelerating the engine, said timing control comprising, a suction motor having first and second means responsive to engine developed suction to respectively operate the motor to advance and retard the spark, means normally operative to cut off suction to the second means for rendering the motor inoperative to retard the spark, mechanical means responsive to movement of the throttle control mechanism to accelerate the engine to initiate supply of suction to the second means for operating the motor to retard the spark and to cut off suction to the first means, to render the motor inoperative to advance the spark during the initial phase of movement of the mechanism, and to thereafter maintain such supply of suction, and timing means rendered operative in response to said initial phase of movement of the mechanism, for cutting off the supply of suction to the second means after a preselected time interval following said initiation of the supply of suction, and to connect the first means to the supply of suction, wherein the means responsive to movement of the throttle control mechanism for accelerating the engine comprises, a lever, valve means connected to the lever for supplying the engine developed suction to the second means, and means for locking the valve means to maintain such supply of suction.

7. A device as defined by claim 6 wherein the timing means for cutting off the supply of suction to the second means comprises, means for releasing the valve means from locked condition and for actuating it to expose the first means to such suction after said preselected time interval advancing the spark.

8. A spark timing control according to claim 6 including means to adjust to timing means to vary the preselected time interval.

9. A spark timing control for an internal combustion engine having a timed spark producing means, a throttle and a control mechanism connected thereto for accelerating the engine, the timing control comprising a suction motor and supply means normally operative to supply suction to said motor from a source of variable engine produced suction to actuate said motor to advance the timing of the spark in accordance with such suction, mechanical means connected to and responsive to movement of the throttle control mechanism to accelerate the engine to render said supply means inoperative to supply suction to said motor during the initial phase of movement of said mechanism and to thereafter maintain said supply means inoperative to thus terminate advance of the timing of the spark by said suction supply means, and timing means rendered operative in response to said initial phase of movement of the throttle control mechanism for restoring operation of said supply means to supply suction from said source to the motor after a preselected time interval following the rendering of the supply means inoperative, wherein the means connected to and responsive to the initial phase of movement of the throttle control mechanism to accelerate the engine comprises a lever connected to said supply means for operating it, and means for locking the lever to maintain the supply means inoperative to supply suction to said motor.

10. A device as defined in claim 9, wherein the timing means for restoring operation of the supply means includes means for releasing the locking means and for actuating the lever to render the supply means operative to supply suction to said motor.

11. A device as defined in claim 10, wherein the timing means is provided with an adjusting means to vary the preselected time interval.

* * * * *